United States Patent [19]

Bucalo et al.

[11] Patent Number: 5,033,124

[45] Date of Patent: Jul. 23, 1991

[54] ZIPPERLESS CHAPS

[76] Inventors: Elizabeth D. Bucalo; Jon A. Lingerfelt, both of 26 Braemar Rd., Setauket, N.Y. 11733

[21] Appl. No.: 590,817

[22] Filed: Oct. 1, 1990

[51] Int. Cl.[5] ..... A41D 1/08

[52] U.S. Cl. ..... 2/227; 2/22; 2/46; 2/242; 2/231; 2/214; 2/270

[58] Field of Search ..... 2/227, 242, 23, 22, 2/46, 231, 270, 214, 243 R, 243 B, 51

[56] References Cited

U.S. PATENT DOCUMENTS

| | | | |
|---|---|---|---|
| D. 201,861 | 8/1965 | Cummins | D3/26 |
| 3,137,081 | 6/1964 | Boyd | 2/232 |
| 3,269,036 | 8/1966 | Parker et al. | 2/22 |
| 3,517,394 | 6/1970 | Robinson | 2/51 |
| 4,110,845 | 9/1978 | Chellis | 2/62 |
| 4,266,299 | 7/1979 | Beal | 2/227 |
| 4,458,363 | 7/1984 | Harvey | 2/22 |
| 4,506,391 | 5/1983 | Rodman | 2/227 |
| 4,622,697 | 11/1986 | Tajima | 2/242 |
| 4,638,509 | 1/1987 | Charron | 2/46 |
| 4,697,286 | 10/1987 | Cho | 2/51 |
| 4,918,760 | 4/1990 | Grilliot et al. | 2/227 |
| 4,984,303 | 1/1991 | Ross | 2/22 |

*Primary Examiner*—Werner H. Schroeder
*Assistant Examiner*—Gloria Hale
*Attorney, Agent, or Firm*—Leonard Belkin

[57] ABSTRACT

A pair of chaps for use in riding a saddled horse comprising a sheet of material made from neoprene between ⅛ and ¼ inch in thickness in which VELCRO strips are used on the leg portions to wrap around each leg and VELCRO strips are employed on the waist band. Suede strips on the legs facing the saddle are employed to resist rubbing against the saddle. The waist band is also lined with suede.

5 Claims, 2 Drawing Sheets

ZIPPERLESS CHAPS

BACKGROUND OF THE INVENTION

The present invention relates to zipperless chaps and more particularly to a protective garment for use over trousers or pants when riding a saddled horse.

Chaps, which is a contraction of chaparejos, are leather trousers which are worn over ordinary trousers to protect the legs of a person riding a horse. Typically the chaps are attached by the use of zippers and a belt around the waist.

Such chaps tend to be inflexible, heavy, and incapable of being adjusted for use over a range of sizes. Leather also tends to bunch and creep up making the chaps uncomfortable. In addition, the leather in time stretches which adversely affects the fit of the chaps. The zippers also are always breaking requiring repeated repairing.

U.S. Design Pat. No. 201,861 illustrates a padded protector for the legs showing the use of a belt on top and ties on the bottom. There is no information on the details of construction or material.

U.S. Pat. No. 3,269,036 shows a protective legging with straps and a zipper.

U.S. Pat. No. 4,266,299 discloses a protective garment covering the back, chest and legs of the wearer, showing connectors of "hermaphroditic" material, such as that sold under the trademark VELCRO.

U.S. Pat. No. 4,506,391 describes chaps with a zipper and a belt, having flaps to facilitating freedom of movement of the wearer.

U.S. Pat. No. 4,638,509 shows protective trousers for use over a wet suit using clips and straps for connecting the open sides together.

U.S. Pat. No. 4,843,654 discloses cold weather riding pants employing insulating material with an adjustable stirrup, zippers and a frictional material inserted along the insides of the legs.

U.S. Pat. No. 4,914,756 shows trousers for the handicapped which can be readily donned due to its construction in which the sides are split.

None of the preceding patents teaches or suggests the present invention.

SUMMARY OF THE INVENTION

In this invention there is provided chaps which are constructed from a spongy, elasticized, spongy material and capable of being adjustable over a range of sizes.

A preferred embodiment of this invention consists of chaps made from a neoprene material with a strip of suede or leather along the length of the leg for contact with the saddle to prevent rubbing, and the use of VELCRO or similar contact material for mounting the chaps.

It is thus a principal object of this invention to provide a chaps with improved wear and comfort charateristics.

Other objects and advantages of this invention will hereinafter become obvious from the following description of the preferred embodiments of this invention.

DESCRIPTION OF THE PREFERRED EMBODIMENT

Figure 1:
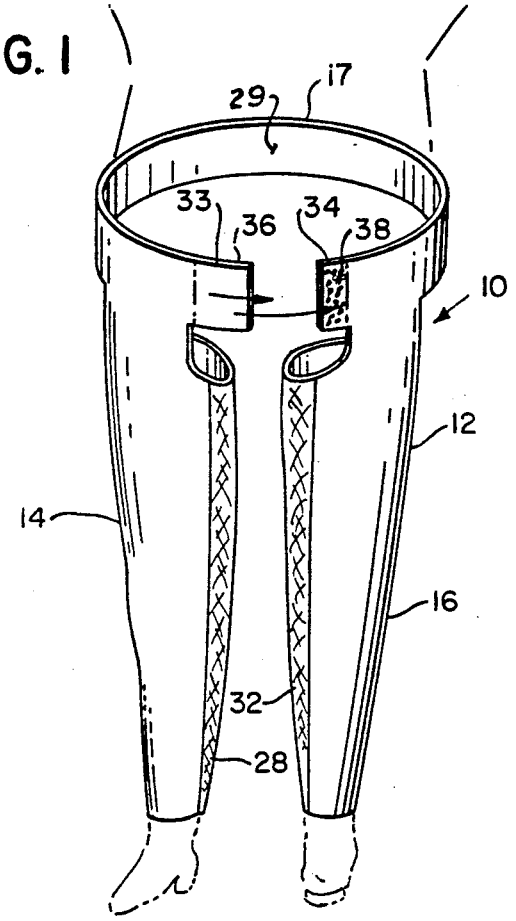
FIG. 1 is a perspective view of a preferred embodiment of this invention taken from the front in the process of being mounted.

Referring to the drawings, chaps 10 consists of a unitary piece of a suitable elasticized material 12 such as neoprene between ⅛ and ¼ inch in thickness having the shape and the construction now to be described. The elasticized material increases the comfort of the rider and improves control over the horse.

It is understood that although material 12 is a single piece it may be in fact made up of sections which are stitched or otherwise attached together to obtain the exact shape and tailoring desired.

Chaps 10 consists of a pair of right and left leg sections 14 and 16, respectively, identical in construction and the mirror image of each other, and a waist or belt section 17.

Figure 4:
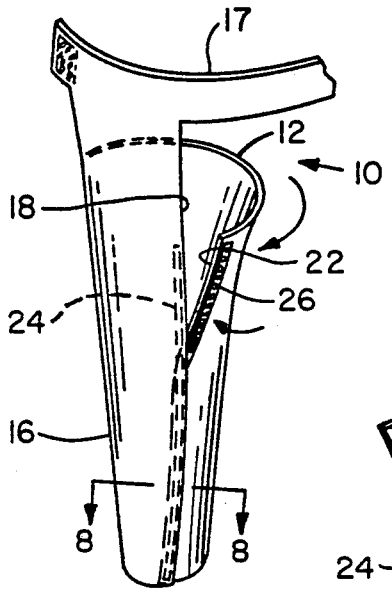
FIG. 4 is an isometric view showing how a leg is closed.
Figure 5:
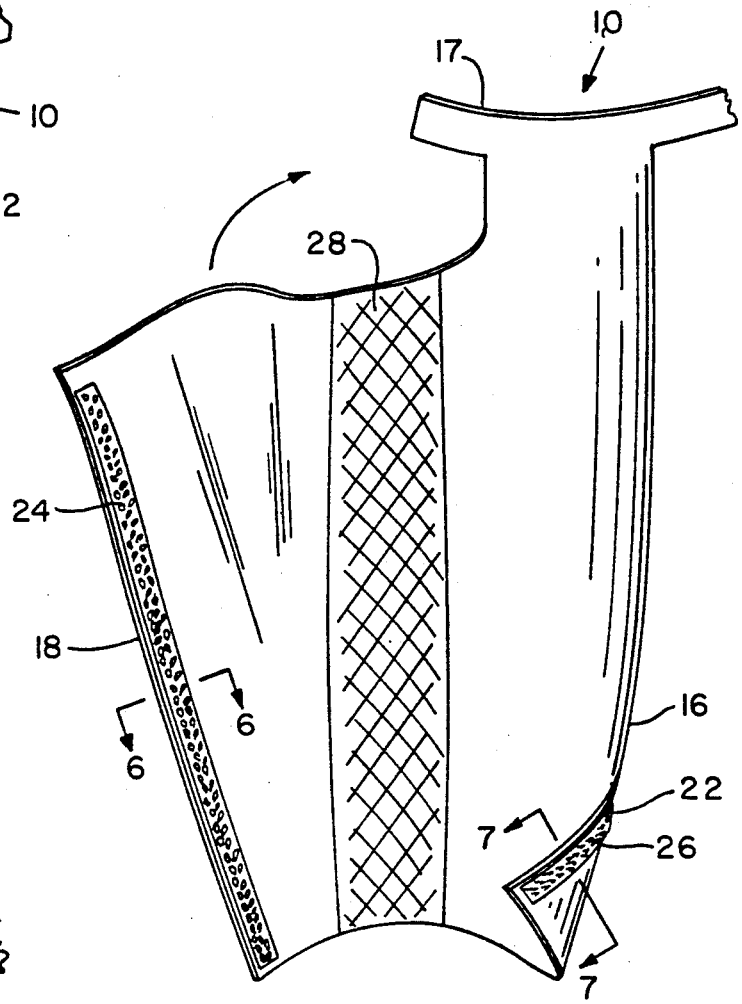
FIG. 5 is an isometric view with one leg opened.
Figure 6:
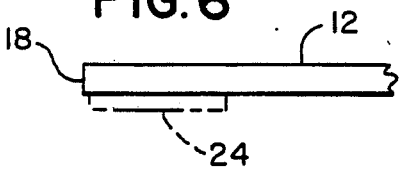
FIG. 6 is a view along 6—6 of FIG. 5.
Figure 7:
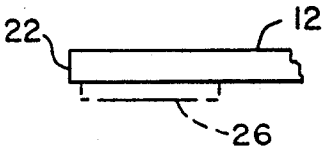
FIG. 7 is a view along 7—7 of FIG. 5.
Figure 8:
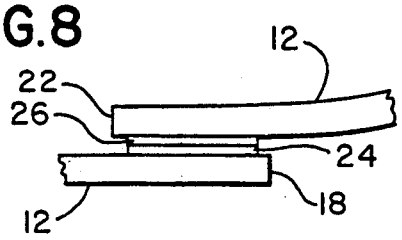
FIG. 8 is a view along 8—8 of FIG. 4.

Referring to left leg section 16, FIGS. 4 and 5 in particular, it will be seen that the two free edges 18 and 22 are lined with strips 24 and 26 of jointly adherent material such as VELCRO, strip 24 being on the inside of leg section 16 and strip 22 being on the outside of leg section 16 so that when edges 18 and 22 are made to overlap with the outer edge directed rearwardly as shown in FIG. 4 covering the wearer's left leg, the two strips 24 and 26 will mate and stay in place.

Figure 3:
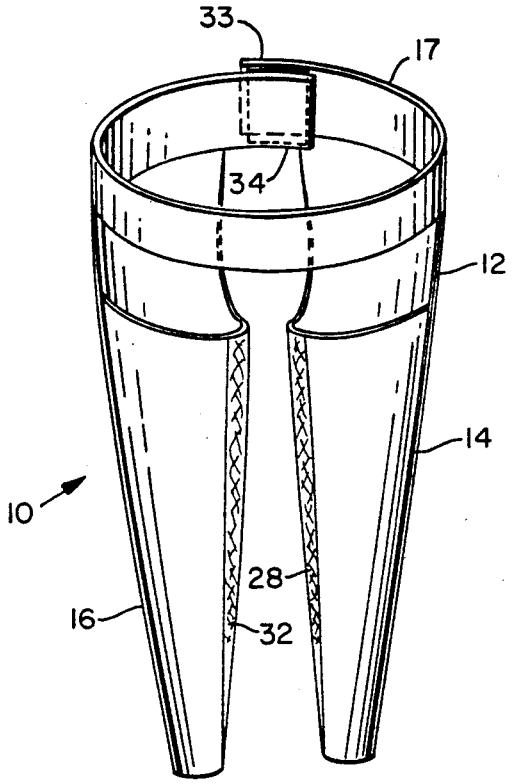
FIG. 3 is a view similar to FIG. 1 taken from the rear.
Figure 2:
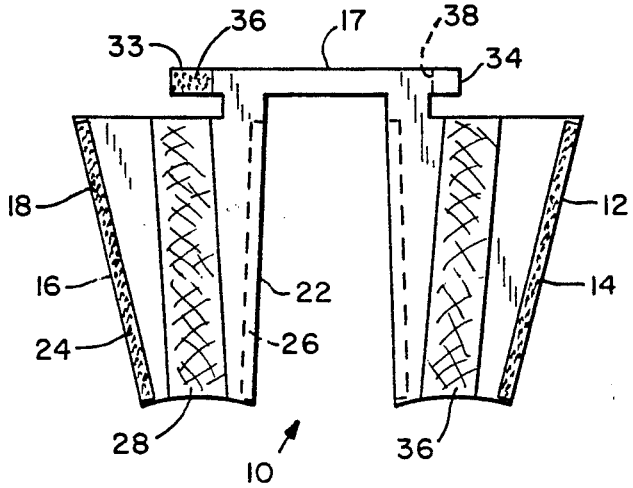
FIG. 2 is a plan view of the embodiment open and flat showing the outside.

On the outside of each leg section 14 and 16, FIGS. 1 and 3 in particular, and facing each other so as to make contact with and grip the saddle, are strips 28 and 32 of suede or leather material to provide a rough surface to resist rubbing and to protect material 12 against wear and possible tearing.

Waist or belt section 17 is provided on the inside with a strip 29 of a material with a rough surface such as suede to help keep chaps 10 in place while being worn.

The overlapping ends 33 and 34 of waist section 17 are provided with strips 36 and 38 of adherent material such as VELCRO. The use of the adherent strips 24,26 and 36,38 make it convenient to cover a range of sizes of the wearer so that different wearers can share the same chaps, and the same chaps can be used if the wearer gains or loses weight. Also, the use of VELCRO makes it possible to adjust to any long term stretching or even shrinking of the material.

It is thus seen there has been provided chaps with improved wearing and comfort characteristics and which is very much lighter in weight than chaps now currently in use.

While only a certain preferred embodiment of this invention has been described it is understood that many variations are possible without departing from the principles of this invention as defined in the claims which follow.

What is claimed is:

1. A pair of chaps, for use by a rider when riding a saddled horse, of single piece construction comprising two leg portions and an upper portion, said single piece being made from an elasticized, spongy material, said upper portion consisting of a waist band with overlapping ends, each of said leg portions extending down from said waist band in the form of a flat sheet of said material sufficiently wide to be capable of completely surrounding a leg and to overlap along the edges of said sheet along the part of said leg facing away from said horse with one edge overlapping the other edge facing in a rearwardly direction, a strip of material lining the length of each leg portion when wrapped around a leg so that the strip on both of said leg portions face each other to make contact with the saddle on said horse for resisting sliding, strips of adherent material on the overlapping ends of said waist band and the leg portions so that when said overlapping ends are engaged said adherent material will hold said overlapping ends in place, said overlapping ends being thereby adjustable to cover a range of sizes of said wearer both around the waist and each of the legs of said rider.

2. The pair of chaps as recited in claim 1 wherein the spongy material is neoprene.

3. The pair of chaps of claim 2 wherein said neoprene is $\frac{1}{8}$ and $\frac{1}{4}$ inch in thickness to permit adequate flexibility for riding.

4. The pair of chaps of claim 3 wherein the strips of material extending the lengths of said leg portions are made of suede.

5. The pair of chaps of claim 4 wherein said waist band is lined along the inside with suede.

* * * * *